US010704316B2

(12) United States Patent
Kendall

(10) Patent No.: US 10,704,316 B2
(45) Date of Patent: Jul. 7, 2020

(54) PROTECTIVE COVER

(71) Applicant: Endura Products, Inc., Colfax, NC (US)

(72) Inventor: Adam Kendall, Burlington, NC (US)

(73) Assignee: Endura Products, LLC, Colfax, NC (US)

( * ) Notice: Subject to any disclaimer, the term of this patent is extended or adjusted under 35 U.S.C. 154(b) by 157 days.

(21) Appl. No.: 15/967,995

(22) Filed: May 1, 2018

(65) Prior Publication Data

US 2019/0338544 A1 Nov. 7, 2019

(51) Int. Cl.

| | |
|---|---|
| ***E06B 1/70*** | (2006.01) |
| ***E04G 21/30*** | (2006.01) |
| ***E06B 7/23*** | (2006.01) |

(52) U.S. Cl.

CPC ..... *E06B 1/70* (2013.01); *E04G 21/30* (2013.01); *E06B 7/2316* (2013.01)

(58) Field of Classification Search

CPC ..... E06B 1/70; E06B 7/2316; E04G 21/30
See application file for complete search history.

(56) References Cited

U.S. PATENT DOCUMENTS

| | | | | |
|---|---|---|---|---|
| 5,588,266 | A * | 12/1996 | Headrick | E06B 1/70 118/504 |
| 5,611,173 | A * | 3/1997 | Headrick | E06B 1/70 118/504 |
| 8,567,128 | B2 * | 10/2013 | Van Camp | E06B 1/70 49/468 |
| 8,739,469 | B1 | 6/2014 | Fortun et al. | |
| 8,857,107 | B1 * | 10/2014 | Key | E06B 1/70 49/460 |
| D797,309 | S * | 9/2017 | Jaskiewicz | D25/48.2 |
| 10,077,593 | B2 * | 9/2018 | Meeks | E06B 1/70 |
| 2006/0053695 | A1 * | 3/2006 | Palenske | E06B 1/70 49/468 |
| 2008/0229669 | A1 * | 9/2008 | Abdollahzadeh | E06B 1/70 49/468 |
| 2012/0085037 | A1 * | 4/2012 | Van Camp | E06B 1/70 49/468 |

(Continued)

FOREIGN PATENT DOCUMENTS

| | | |
|---|---|---|
| CA | 2754367 | 4/2012 |

OTHER PUBLICATIONS

Canadian Office Action for Application No. 300669, dated Feb. 28, 2019, 4 pgs.

(Continued)

*Primary Examiner* — Marcus Menezes
(74) *Attorney, Agent, or Firm* — Womble Bond Dickinson (US) LLP

(57) ABSTRACT

A cover for removable protection of a threshold is disclosed. The threshold may be of the type having a sill deck terminating in an upwardly extending dam and a threshold cap disposed along an interior side of the dam. The cover has at least a cap protecting member configured to extend over the threshold cap of the threshold. The cap protecting member includes an engagement portion configured to be positioned along an exterior side of the dam. The engagement portion has a hooked tip. Upon completion of construction, the cover is designed to be removed from the threshold to expose at least the threshold cap below.

12 Claims, 10 Drawing Sheets

(56) References Cited

U.S. PATENT DOCUMENTS

| | | | | |
|---|---|---|---|---|
| 2012/0180397 | A1* | 7/2012 | Van Camp | E06B 1/70 49/467 |
| 2013/0305610 | A1* | 11/2013 | Meeks | E06B 1/70 49/471 |

OTHER PUBLICATIONS

Young Manufacturing Inc.—Sill Cover, known at least as early as Jan. 4, 2018, 2 pgs.

* cited by examiner

PROTECTIVE COVER

FIELD OF INVENTION

This disclosure relates to thresholds used in commercial and residential building entryways. Particularly, this disclosure relates to protective covers intended for temporary use with thresholds during building construction or renovation.

BACKGROUND

Entryways in commercial and residential buildings serve several important purposes in their role as a transition from an exterior to an interior environment. The primary goal of an entryway is to allow for ingress and egress while insulating the interior from the exterior. Entryways are intended to prevent intrusion of rainwater. Entryways are also intended to prevent passage of air through the entryway when a door panel is in the closed position, keeping out cold air in the winter and keeping in conditioned air in the summer. Entryways can also enhance the appearance of a building using window features, French door arrangements, and varying finishes of sill decks and threshold caps.

Most entryways begin with the same set of base components. Nearly all entryways are framed by a header jamb connected across the top of two vertical side jambs. The bottom of the entryway is then defined by a threshold. These thresholds are typically comprised of a substrate, a sill deck, and a threshold cap. The substrate provides a base for the sill deck. The sill deck provides a durable tread surface covering the substrate. Sometimes the substrate and the sill deck are integrated into a single component. The threshold cap is provided to form a sealing surface with the bottom of a door panel. Often, the threshold cap is self-adjusting or manually adjustable to help maintain a proper seal with the bottom of the door panel.

Sill decks and threshold caps are often installed in the entryway of buildings relatively early in the construction process in order to substantially close the building to the environment. After installation, a significant amount of construction work remains to be performed within the house or building. Continued heavy traffic of workers entering the building, including the movement of substantial equipment and materials, can often lead to denting, scuffing, or scratching, or otherwise damaging the sill deck or other threshold components. Other substances can also stain the threshold during construction, such as dripping paint, stain, or masonry mortar.

Protective covers have been used to temporarily remain on the threshold during construction. These protective covers help to protect the surface of the sill deck and threshold cap from damage during construction and can be removed by the builder or homeowner after completion of the final walk through and clean up, to preserve the "like new" appearance of the entryway of a new house.

Though temporary protective covers for thresholds are known, door hangers may look to minimize material costs by providing their entryways without such protective covers. Therefore, there remains a need for an improved cover that can be easily manufactured at a low cost and with an option for the degree of protection provided, to promote the use of protective covers during construction or remodeling.

SUMMARY

One embodiment of the present disclosure includes a cover for removable protection of a threshold. The threshold may be of the type having a sill deck terminating in an upwardly extending dam and a threshold cap disposed along an interior side of the dam. The cover has at least a cap protecting member configured to extend over the threshold cap of the threshold. The cap protecting member includes an engagement portion configured to be positioned along an exterior side of the dam. The engagement portion has a hooked tip. Upon completion of construction, the cover is designed to be removed from the threshold to expose at least the threshold cap below.

These and other aspects of the present invention will become apparent to those skilled in the art after a reading of the following description of the preferred embodiments, when considered in conjunction with the drawings. It should be understood that both the foregoing general description and the following detailed description are exemplary and explanatory only and are not restrictive of the invention as claimed.

DETAILED DESCRIPTION OF THE DRAWINGS

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

As used herein, the term "width" is defined as the dimension along the X axis in the figures. The X axis also defines the "lateral" direction. The term "length" refers to the dimension or direction defined by the Y axis in the figures. The term "height" refers to a dimension along the Z axis as defined in the figures, which may also be referred to as the vertical direction.

Figure 1:
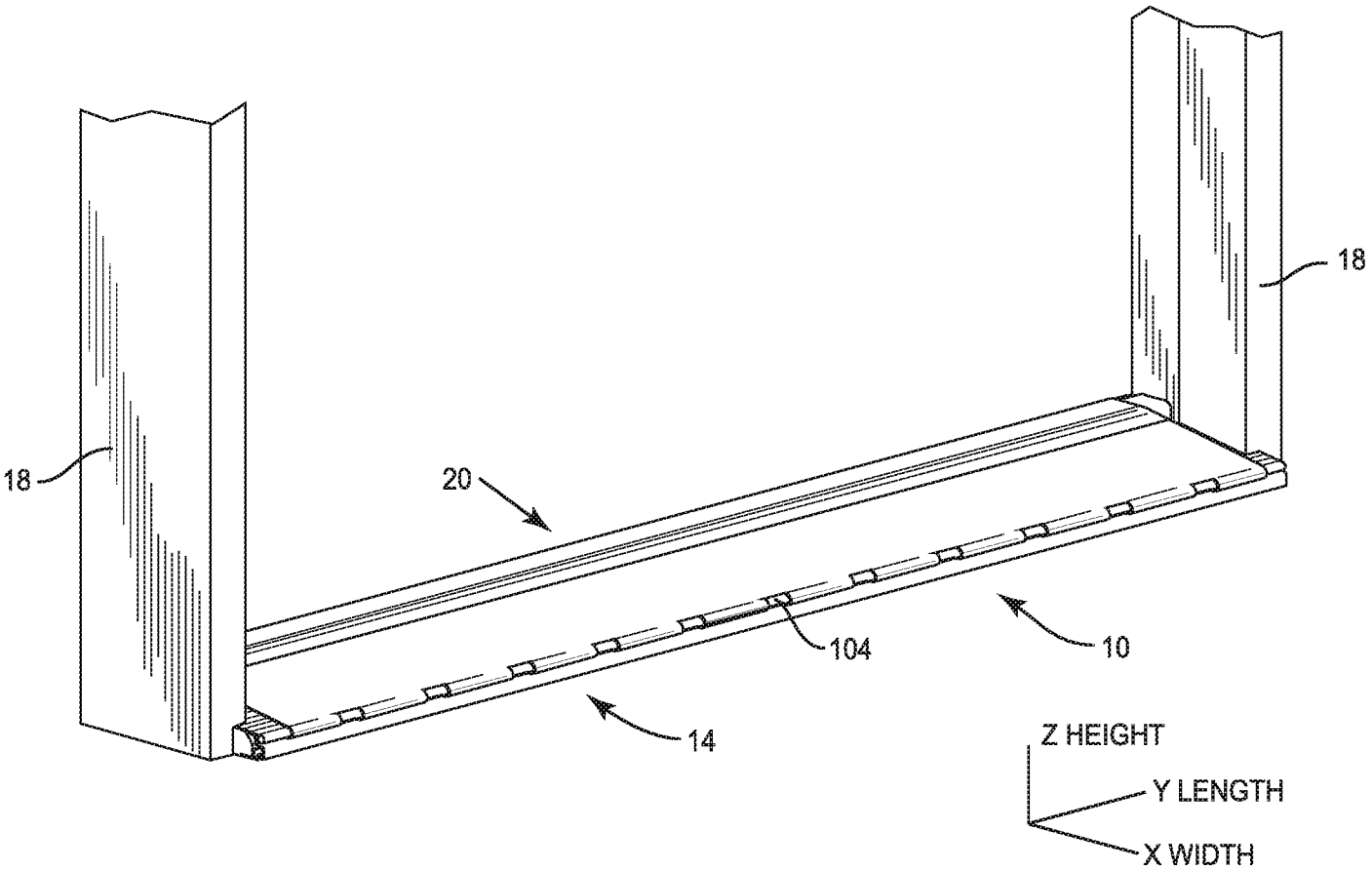
FIG. 1 is a perspective view of an entryway system having a protective cover according to an embodiment of the present disclosure.

Turning to the figures, FIG. 1 shows an entryway 10 having a threshold 14 and a pair of jambs 18 installed on each side of the threshold 14. The threshold 14 is shown with a protective cover 20 positioned thereon. In some embodiments, the protective cover 20 is sized to protect substantially the entire width of the threshold 14. In most embodiments, the protective cover 20 will overlap at least the majority, and preferably substantially all, of the length of the threshold 14. It should be understood that the protective cover 20 may be slightly shorter in length than the threshold 14 in order to maintain easy removability from between jambs 18. In one example, the threshold 14 extends under a portion of jambs 18 of the entryway 10, while the protective cover 20 is intended to be positioned adjacent to or contoured with the jambs 18.

The protective cover 20 is intended for use as a temporary construction cover for removable protection of the threshold 14. When a pre-hung door is shipped, the protective cover 20 may be attached to the threshold 14. Alternatively, the protective cover 20 may be applied to the threshold 14 on the construction site. Upon completion of construction, the protective cover 20 is designed to be removed from the threshold 14 to expose at least a threshold cap of the threshold.

Consistent with the intended temporary, disposable nature of the protective cover 20, the protective cover may be preferably formed as a thin plastic extrusion, for example, from a rigid vinyl.

One skilled in the art understands that a threshold 14 may be considered as the boundary between an interior and an exterior of a building. FIG. 1 is a view from the exterior of the entryway 10. The interior-exterior direction extends along the X-axis as defined in the figures. As used herein, the relative terms "interior" and "exterior" are used to describe portions of the threshold 14 or the protective cover 20, where a portion described as "interior" is intended to be toward the interior of a building when the product is in use and a portion described as "exterior" is intended to be toward the exterior of the building with the product is in use.

Figure 2:
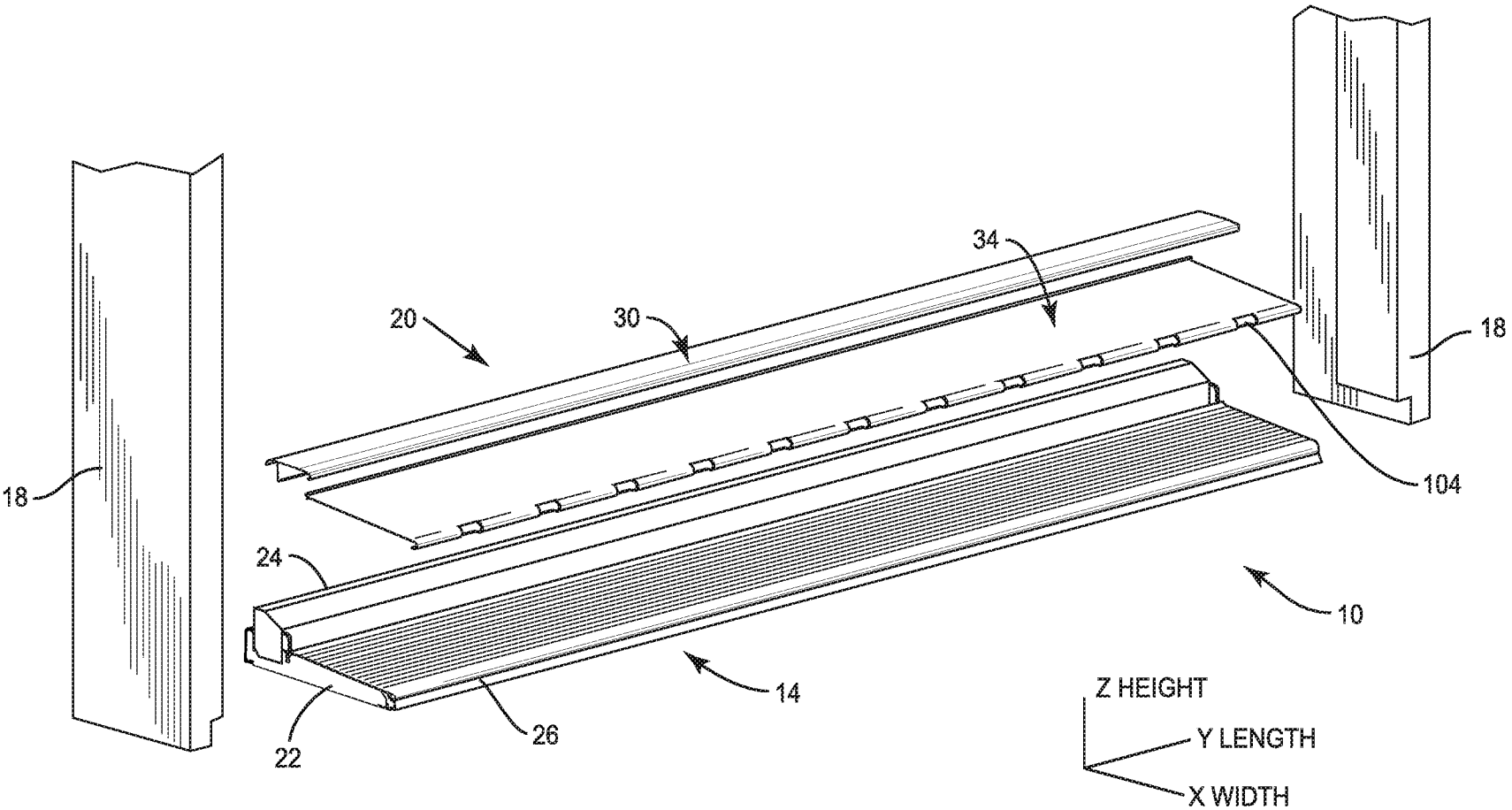
FIG. 2 is an exploded perspective view of the entryway system of FIG. 1.

FIG. 2 shows an exploded view of the entryway 10. With the protective cover 20 lifted from the threshold 14, it can be seen that the threshold 14 may further comprise a substrate 22, a threshold cap 24, and a sill deck 26. The protective cover 20 may comprise a cap protecting member 30 and a deck protecting member 34.

Figure 3:
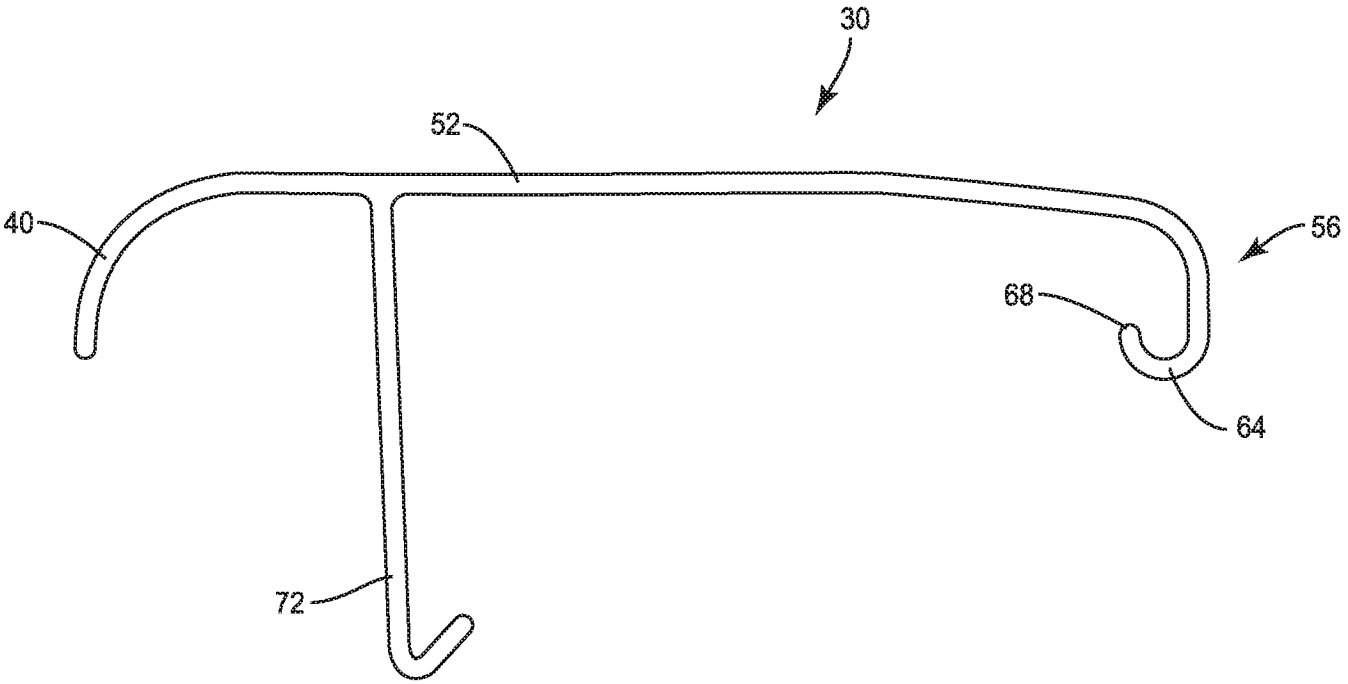
FIG. 3 is a profile view of a cap protecting member of a protective cover according to a first embodiment.
Figure 4:
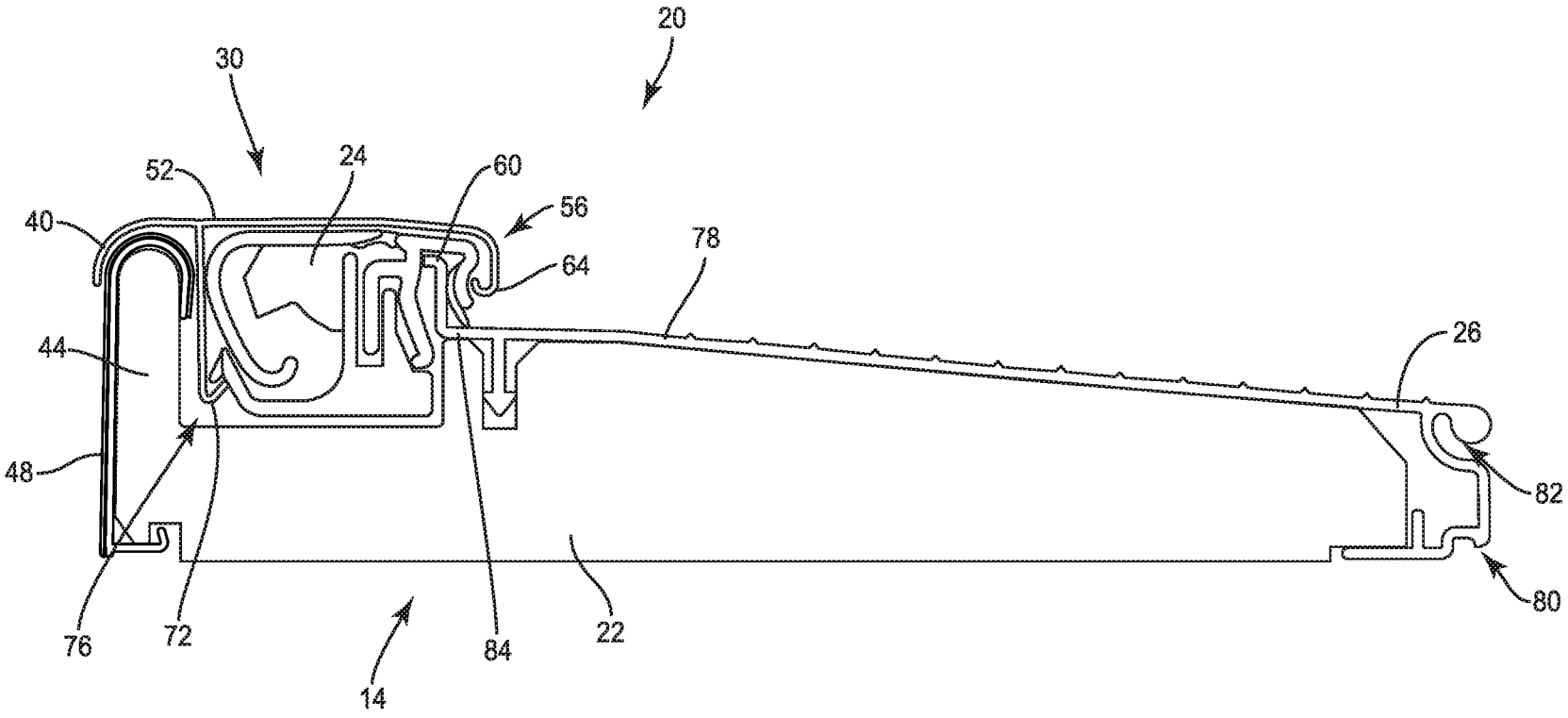
FIG. 4 is a profile view of the cap protecting member of FIG. 3 engaged with a threshold.

FIG. 3 is a profile view of the cap protecting member 30 according to one embodiment of the protective cover 20. As shown in FIG. 4, the cap protecting member 30 may be used without the deck protecting member to itself form the protective cover 20. The cap protecting member 30 may include an interior flange 40 that may be configured to be disposed adjacent to the interior of a nosing 44 or nosing cover 48 (FIG. 4), a cap covering portion 52 extending substantially horizontally from the interior flange 40, and an engagement portion 56 extending from the cap covering portion 52. The engagement portion 56 is configured to be positioned along an exterior side of the dam 60 (FIG. 4).

The engagement portion 56 can include a hooked tip 64. A distal end 68 of the hooked tip 64 may be configured to extend upwardly when the cap protecting member 30 is engaged with the threshold 14 as shown in FIG. 4. The cap protecting member 30 may also include a retention arm 72 extending from the cap covering portion 52.

FIG. 4 shows the cap protecting member 30 engaged with the threshold 14. The interior flange 40 of the cap protecting member 30 is disposed adjacent to an interior of the nosing cover 48. The retention arm 72 extends between the nosing 44 and the threshold cap 24 to help maintain the engagement of the cap protecting member 30 with the threshold 14. The engagement portion 56 of the cap protecting member 30 is disposed along an exterior side of the dam 60, which extends from the sill deck 26. In the illustrated embodiment, the hooked tip 64 extends toward the dam 60.

In the illustrated embodiment of FIG. 4, the substrate 22 defines a sill channel 76 for receiving the threshold cap 24. In the embodiment shown, the threshold cap 24 is self-articulating or self-adjustable such that a top surface of the threshold cap is yieldably biased toward a raised position to seal with a bottom of a door panel (not shown) when the protective cover 20 is removed from the threshold 14. A suitable self-articulating threshold cap 24 is described in U.S. Pat. No. 9,371,682, which is jointly owned with the present disclosure, and which is incorporated herein it its entirety. As shown in FIG. 4, the cap protecting member 30 is configured to retain the threshold cap 24 in a lowered position below an uppermost raised position thereof. In other embodiments, the threshold cap 24 may be manually adjustable. A manually adjustable threshold cap can be adjusted vertically upon intervention by the operator.

As further illustrated in FIG. 4, the sill deck 26 may be disposed on the top of the substrate 22 to provide a tread surface 78 for the threshold 14. The sill deck 26 has an exterior end 80 having a slot 82 formed therein. The slot 82 may be generally used to attach deck extensions (not shown) to the sill deck 26. An opposite interior end 84 of the sill deck 26 includes the dam 60 extending upwardly relative to the tread surface 78.

Figure 5:
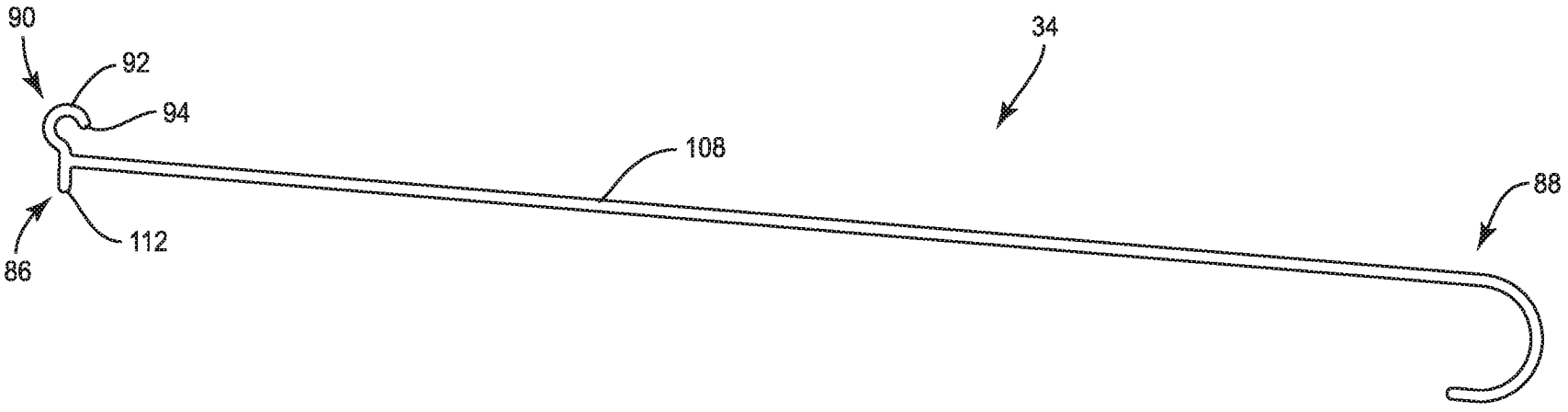
FIG. 5 is a profile view of a deck protecting member of a protective cover according to the first embodiment.
Figure 6:
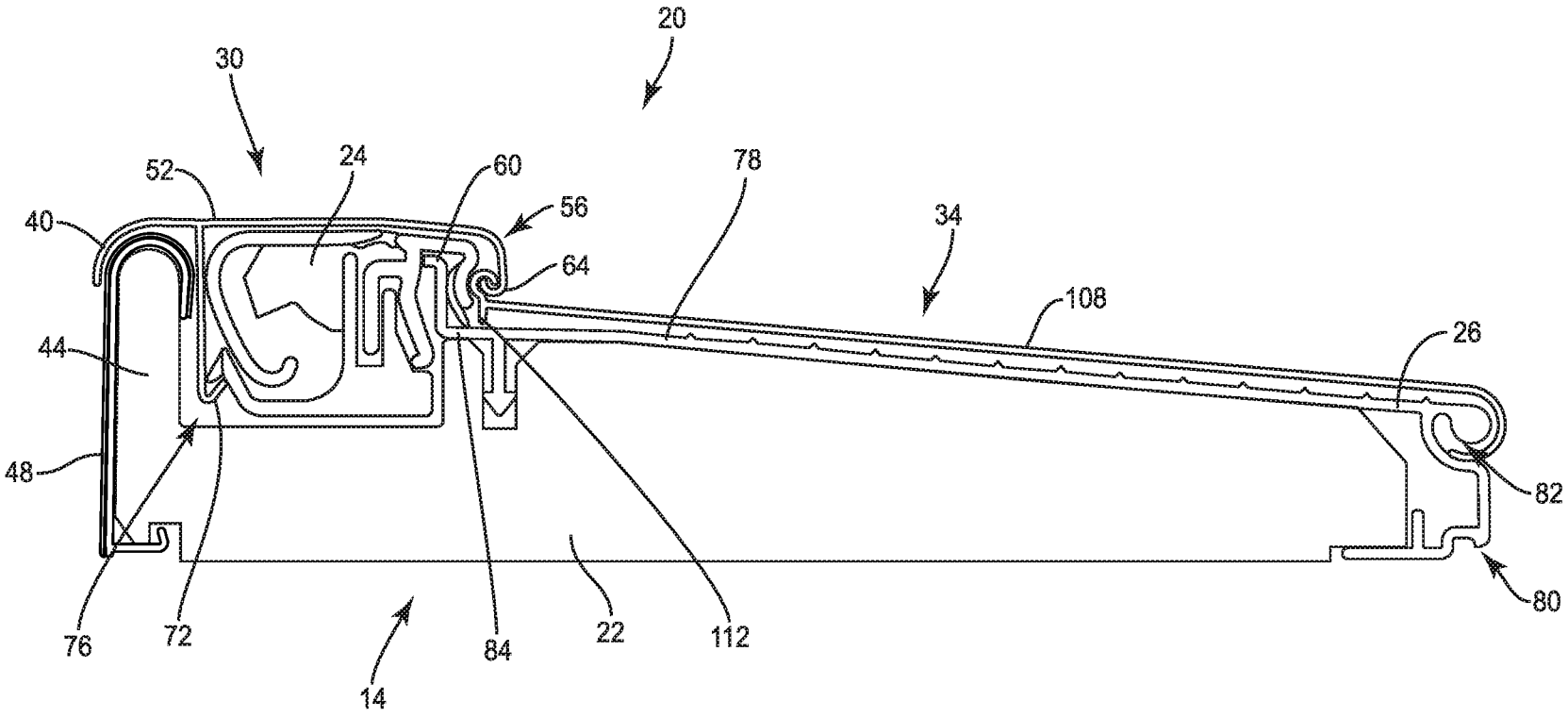
FIG. 6 is a profile view of the deck protecting member of FIG. 5 engaged with a threshold.

FIG. 5 shows a profile of the deck protecting member 34 of the protective cover 20. Again, as discussed above, the deck protecting member 34 is optional in some embodiments. The deck protecting member 34, if present, is configured to overlay the sill deck 26 of the threshold 14 as shown in FIG. 6. The deck protecting member 34 has an interior end 86 and an exterior end 88. The interior end 86 of the deck protecting member 34 has an attachment portion 90 configured to engage with the hooked tip 64 of the engagement portion 56 of the cap protecting member 30 as shown in FIG. 6. The attachment portion 90 may include a hook 92 configured to extend away from the dam 60. A distal end 94 of the hook 92 may face substantially downward when the deck protecting member 34 is applied to the threshold 14.

In one embodiment, the exterior end 88 of the deck protecting member 34 includes an exterior flange 100 extending therefrom. The exterior flange 100 may include at least one aperture 104 (FIG. 1), formed through the exterior flange and configured to provide drainage. The exterior flange 100 may have a shape configured to at least partially engage the slot 82 formed in an exterior end 80 of the sill deck 26 of the threshold 14 as shown in FIG. 6. For example, exterior flange 100 may project downward and inward relative to an intermediate portion 108 of the deck protecting member 34. The engagement between the exterior flange 100 and the exterior end 80 of the sill deck 26 can help to avoid premature or unintended removal of the deck protecting member 34.

The intermediate portion 108 of the deck protecting member 34 may cover substantially the full width of the sill deck 26. The intermediate portion 108 may be sloped downward, preferably at a substantially constant angle. One or more standoffs 112 may be provided to create separation between the intermediate portion 108 and the tread surface 78 of the sill deck 26. The engagement between the exterior flange 100 and the slot 82 may further assist with creation of separation between the intermediate portion 108 and the tread surface 78. The separation can be beneficial to avoiding water or other debris from becoming trapped between the deck protecting member 34 and the sill deck 26.

To further facilitate drainage, or removal of water or debris residing between the sill deck 26 and the deck protecting member 34, the exterior flange 100 of the deck protecting member 34 includes the at least one aperture 104 (FIG. 1). In one embodiment, a plurality of apertures 104 are formed along the length of the deck protecting member 34 as shown in FIG. 1. The apertures 104 form openings through the exterior flange 100. The apertures 104 may alternatively be formed as notches in the exterior flange 100. The apertures 104 are completely surrounded by a portion of the exterior flange 100 while a notch would be cut into the end of the exterior flange, thereby having only three sides surrounded by the flange material. The apertures 104, for providing drainage, are preferably between about 0.25 inches and about 1.0 inches in length, and more preferably about 0.75 inches long. The apertures 104 may be spaced apart by a distance of about 1 inch to about 5 inches. Preferably, the apertures 104 are spaced apart by a distance of about 2.5 inches to about 4 inches.

Figure 7:
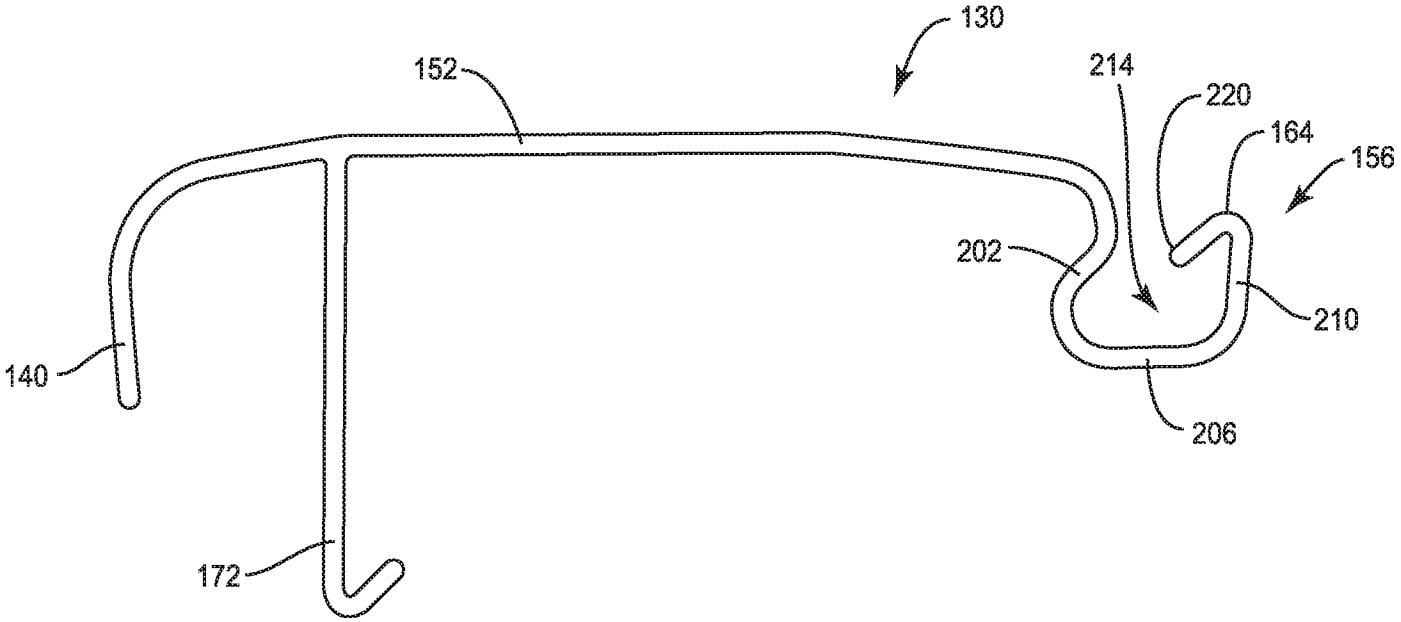
FIG. 7 is a profile view of a cap protecting member of a protective cover according to a second embodiment.
Figure 8:
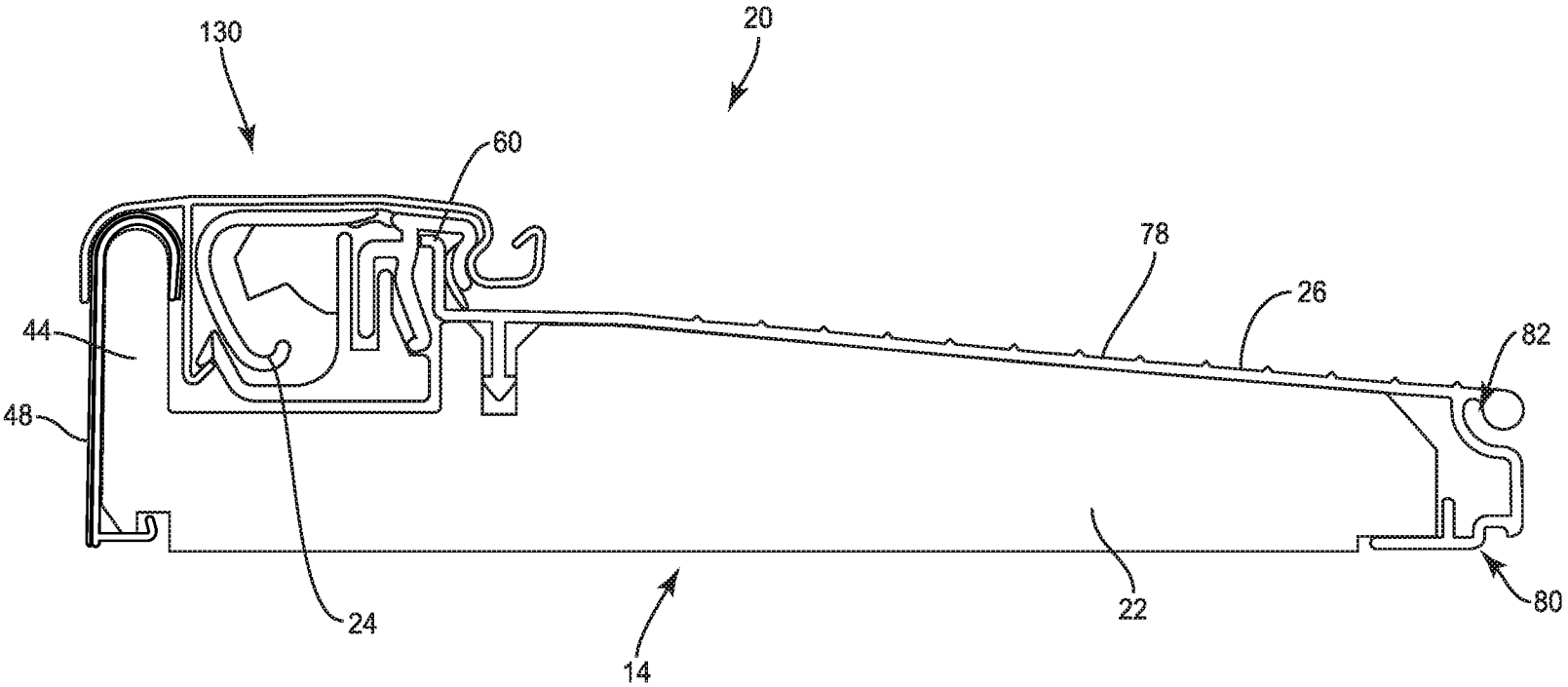
FIG. 8 is a profile view of the cap protecting member of FIG. 7 engaged with a threshold.

FIG. 7 shows a profile view of a cap protecting member 130 according to a second embodiment. Similar to the first embodiment, the cap protecting member 130 includes an interior flange 140 that may be configured to be disposed adjacent to the interior of a nosing 44 or nosing cover 48 (FIG. 8), a cap covering portion 152 extending substantially horizontally from the interior flange 140, and an engagement portion 156 extending from the cap covering portion 152. The engagement portion 156 is configured to be positioned along an exterior side of the dam 60 (FIG. 8). The cap protecting member 130 may also include a retention arm 172 extending from the cap covering portion 152 that may be substantially similar to the retention arm 72 of the first cap protecting member 30 of FIG. 3.

Figure 9:
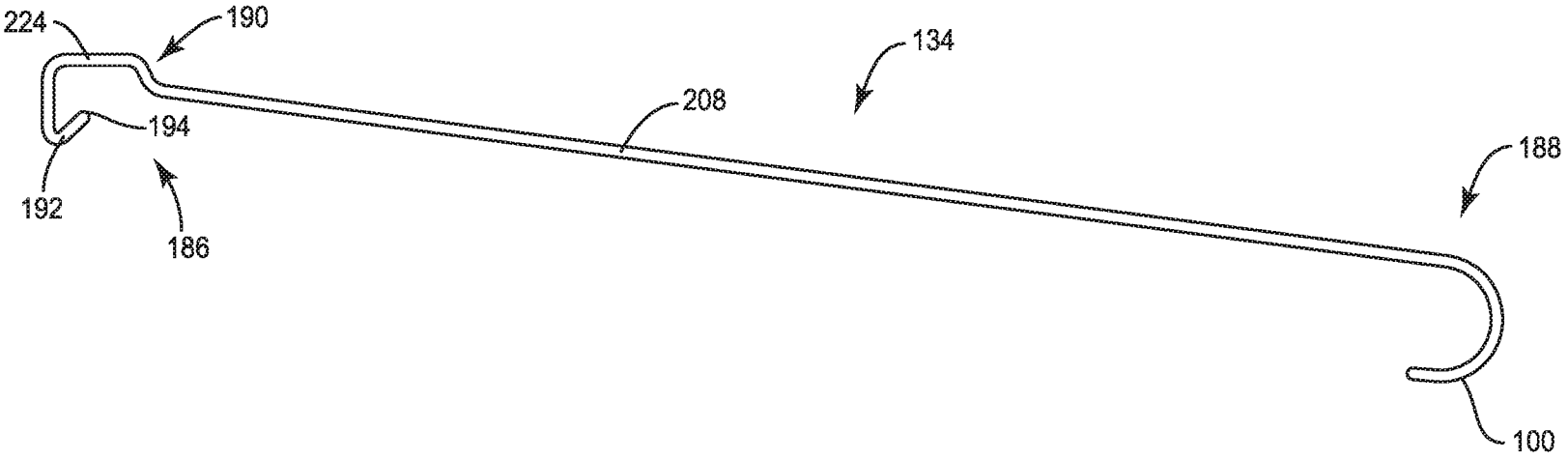
FIG. 9 is a profile view of a deck protecting member of a protective cover according to the second embodiment.

The primary distinction between the cap protecting member 130 of the present embodiment compared to the cap protecting member 30 (FIG. 3) of the first embodiment, is the engagement portion 156. The engagement portion 156 may include a hooked tip 164. The engagement portion 156 may also include a first wall 202 configured to extend substantially downward along the dam 60 (FIG. 8). The first wall 202 may have a reverse S-shaped profile. The profile of the first wall 202 may be configured to mirror an exterior wall of the threshold cap 24 (FIG. 3). A second wall 206 of the engagement portion 156 extends from a bottom of the first wall 202 and configured to extend in a direction away from the dam 60 as shown in FIG. 9. The engagement portion 156 may also include a third wall 210 extending upwardly from an exterior end of the second wall 206. The third wall 210 can terminate in the hooked tip 164. The first wall 202, second wall 206, and third wall 210 are arranged to define a trough 214 when the cap protecting member 130 is engaged with a threshold 14. A distal end 220 of the hooked tip 164 may extend downward and toward the first wall 202.

Figure 10:
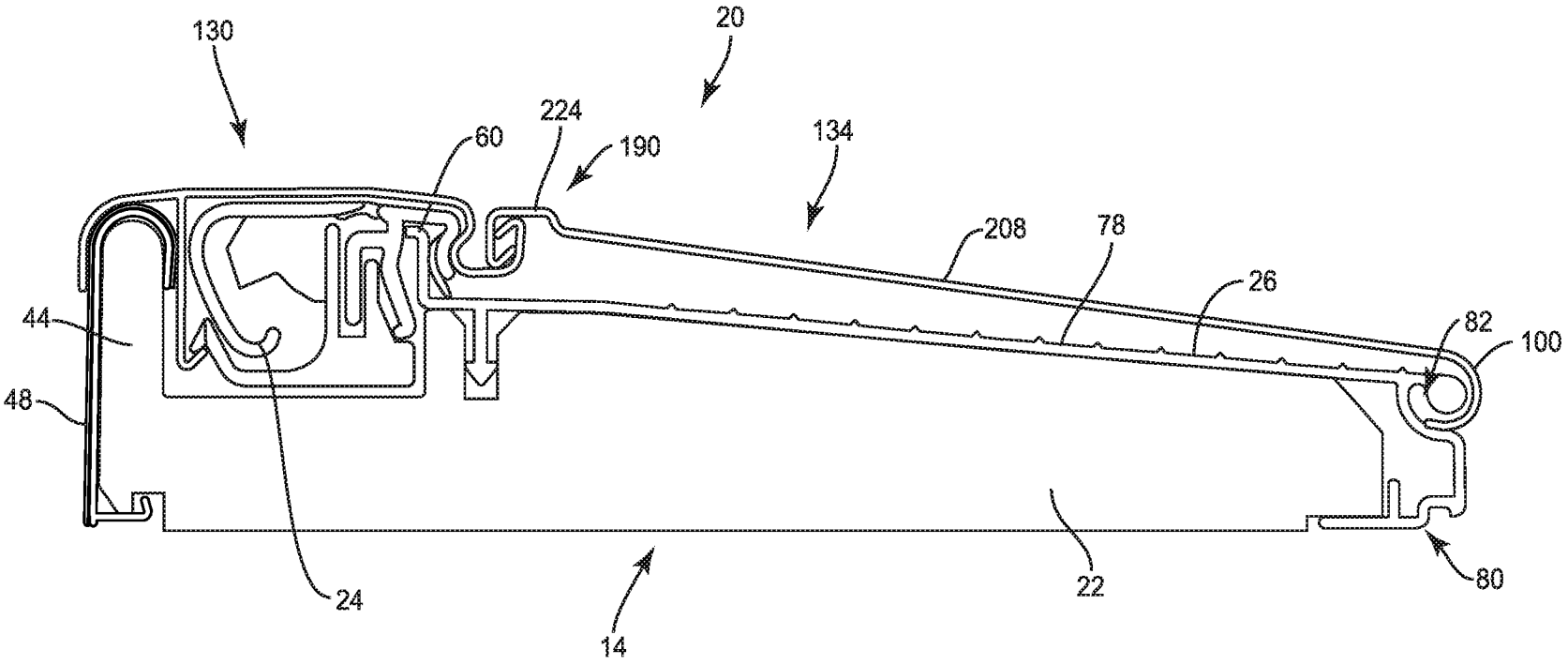
FIG. 10 is a profile view of the deck protecting member of FIG. 9 engaged with a threshold.

FIG. 9 illustrates a deck protecting member 134 according to a second embodiment. As shown in FIG. 10, the deck protecting member 134 is suitable for engagement with the cap protecting member 130 of the second embodiment and capable of engaging the sill deck 26. In some instances, the deck protecting member 134 may be more easily engaged and disengaged with the cap protecting member 130 than the deck protecting member 34 is engaged and disengaged with the cap protecting member 30.

The deck protecting member 134 is configured to overlay the sill deck 26 of the threshold 14 as shown in FIG. 10. The deck protecting member 134 has an interior end 186, an exterior end 188, and an intermediate portion 208 extending between the interior end and the exterior end. The exterior end 188 may include an exterior flange 100 substantially similar to the exterior flange of the deck protecting member 34 of the first embodiment described above with respect to FIGS. 1 and 3. In the illustrated embodiment, the intermediate portion 208 is substantially planar.

The interior end 186 of the deck protecting member 134 comprises an attachment portion 190 configured to engage with the hooked tip 164 of the engagement portion 156 of the cap protecting member 130 as shown in FIG. 10. The attachment portion 190 may include a hook 192 configured to extend away from the dam 60 (FIG. 10). A distal end 194 of the hook 192 faces substantially upward when the deck protecting member 134 is engaged with the threshold 14. The attachment portion 190 may also include a top wall 224 that is offset from a plane of the intermediate portion 208.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A cover for removable protection of a threshold, the threshold having a sill deck terminating in an upwardly extending dam, and a threshold cap disposed along an interior side of the dam, the cover comprising:

a cap protecting member configured to extend over the threshold cap, wherein the cap protecting member includes an engagement portion configured to be positioned along an exterior side of the dam, the engagement portion comprising:

a hooked tip:

a first wall configured to extend substantially downward along the dam, the first wall having a reverse S-shaped profile;

a second wall extending from a bottom of the first wall and configured to extend in a direction away from the dam; and a third wall extending upwardly from an exterior end of the second wall, the third wall terminates in the hooked tip, wherein the first wall, second wall, and third wall define a trough, wherein the cover is designed to be removed from the threshold to expose at least the threshold cap below.

2. The cover of claim 1, wherein the cover is configured to retain the threshold cap below a raised position thereof to which the threshold cap is biased towards.

3. The cover of claim 1, further comprising a retention arm extending from a cap covering portion of the cap protecting member, the retention arm configured to engage the threshold cap and help retain the cover on the threshold.

4. The cover of claim 1, wherein a distal end of the hooked tip extends downward and toward the first wall.

5. The cover of claim 1, further comprising a deck protecting member configured to overlay the sill deck of the threshold, the deck protecting member having an interior end and an exterior end, wherein the interior end of the deck protecting member comprises an attachment portion configured to engage with the hooked tip of the engagement portion of the cap protecting member.

6. The cover of claim 5, wherein the attachment portion comprises a hook configured to extend away from the dam, the hook having a distal end facing substantially upward when the deck protecting member is engaged with the threshold.

7. The cover of claim 5, wherein the exterior end of the deck protecting member comprises a flange extending therefrom, the flange having at least one aperture, or notch, formed through the flange and configured to provide drainage.

8. The cover of claim 7, wherein the flange comprises a shape configured to at least partially engage a slot formed in an exterior end of the sill deck of the threshold.

9. The cover of claim 8, wherein the flange projects downward and inward relative to an intermediate portion of the deck protecting member.

10. The cover of claim 7, wherein the deck protecting member comprises an intermediate portion extending between the attachment portion and the flange, wherein the intermediate portion is substantially planar.

11. The cover of claim 10, wherein the attachment portion comprises a top wall, the top wall being offset from a plane of the intermediate portion.

12. An assembly, comprising:

a threshold comprising:

a sill deck terminating in an upwardly extending dam; and a threshold cap disposed along an interior side of the dam; and a cover according to claim 1.

* * * * *